US005360530A

United States Patent [19]

Gould et al.

[11] Patent Number: 5,360,530

[45] Date of Patent: Nov. 1, 1994

[54] LUBRICATING OIL DEWAXING USING MEMBRANE SEPARATION OF COLD SOLVENT FROM DEWAXED OIL AND RECYCLE OF COLD SOLVENT TO FILTER FEED

[75] Inventors: Ronald M. Gould, Sewell, N.J.; William F. Heaney, Jamison, Pa.; Albert R. Nitsch, Princeton; Howard E. Spencer, Titusville, both of N.J.

[73] Assignee: Mobil Oil Corporation, Fairfax, Va.

[21] Appl. No.: 52,327

[22] Filed: Apr. 23, 1993

[51] Int. Cl.[5] ..... C10G 73/06; C10G 73/32; B01D 39/00; C07C 7/144

[52] U.S. Cl. ..... 208/31; 208/37; 208/38; 210/500.39; 210/654; 585/818; 585/819

[58] Field of Search ..... 208/31, 37, 38; 585/818, 819; 210/500.39, 650, 651, 654

[56] References Cited

U.S. PATENT DOCUMENTS

| | | | |
|---|---|---|---|
| 4,368,112 | 1/1983 | Thompson et al. | 208/31 |
| 4,432,866 | 2/1984 | West et al. | 208/321 |
| 4,532,041 | 7/1985 | Shuey et al. | 585/819 |
| 4,670,151 | 6/1987 | Bitter | 210/641 |
| 4,836,927 | 6/1989 | Wan | 210/651 |
| 4,963,303 | 10/1990 | Anderson | 264/41 |
| 4,985,138 | 1/1991 | Pasternak | 208/308 |
| 5,042,992 | 8/1991 | Blinka et al. | 55/16 |
| 5,067,970 | 11/1991 | Wang et al. | 55/16 |

OTHER PUBLICATIONS

McCabe, et al., Unit Operations of Chemical Engineering, McGraw-Hill, Inc. 1967, pp. 880–883.

*Primary Examiner*—Paul Lieberman
*Assistant Examiner*—Patricia L. Hailey
*Attorney, Agent, or Firm*—Alexander J. McKillop; Malcolm D. Keen; L. Gene Wise

[57] ABSTRACT

A process for solvent dewaxing a waxy oil feed to obtain petroleum oil lubricating stock comprising the steps of contacting a warm waxy oil feed by indirect heat exchange first with cold filtrate, then with refrigerant to crystallize and precipitate the wax in the oil feed to form an oil/solvent/wax mixture. The oil/solvent/wax mixture is diluted with cold solvent to adjust the viscosity of the mixture and the mixture is fed to a filter which filters and removes the wax from the cold oil/solvent-/wax mixture. A cold wax cake is recovered and a cold oil/solvent filtrate stream is recovered. The cold oil/-solvent filtrate stream is fed, at the filtration temperature, to a selective permeable membrane. The membrane selectively separates the cold filtrate into a cold solvent permeate stream and a cold filtrate stream which contains the dewaxed oil and the remaining solvent. The cold solvent permeate stream at the filtration temperature is recycled to the filter feed stream. The cold filtrate stream is then contacted with the warm waxy oil feed by indirect heat exchange. After heat exchange with the warm waxy oil feed, the filtrate is sent to an oil/solvent separation operation in which the remaining solvent is removed from the dewaxed oil and recycled to the dewaxing process and the wax free lubricating oil stock product is recovered.

10 Claims, 1 Drawing Sheet

LUBRICATING OIL DEWAXING USING MEMBRANE SEPARATION OF COLD SOLVENT FROM DEWAXED OIL AND RECYCLE OF COLD SOLVENT TO FILTER FEED

FIELD OF THE INVENTION

The present invention is directed to a process for dewaxing waxy oil feeds.

The present invention is particularly directed to a process for dewaxing waxy petroleum oil fractions.

The present invention is specifically directed to a process for the solvent dewaxing of waxy petroleum oil feeds to obtain lubricating oil stocks which comprises contacting a cold oil/solvent filtrate stream from a solvent dewaxing process with a selective permeable membrane to selectively separate the cold oil/solvent filtrate into a cold solvent permeate stream and a cold filtrate stream. The cold solvent permeate stream is recycled to an oil/solvent/wax feed to the wax filtration step.

The separated cold filtrate stream is contacted by indirect heat exchange with warm waxy oil feed to cool the warm waxy oil feed.

In solvent lube dewaxing, cold solvent is typically added to a hot waxy raffinate to control crystallization of the wax in the feed. Chilling of the feed is accomplished by indirect heat exchange against cold filtrate from the dewaxing filters and with refrigerant. Solvent is usually recovered from the filtrate by a combination of heating, multi-stage flash, and distillation operations. The hot solvent so recovered is then chilled again to the desired temperature for recycling to the wax filter feed.

PRIOR ART

In a typical solvent dewaxing process a waxy oil feed is mixed with solvent from a solvent recovery system. The waxy oil feed/solvent mixture is cooled by indirect heat exchange in a scraped-surface, double pipe heat exchanger against cold filtrate, which is a mixture of oil and solvent recovered from a filter used to separate wax from a wax containing stream. The cold filtrate is a mixture of oil and solvent. The cooled feed mix is injected with additional cold solvent from the solvent recovery system. The resultant mixture is further cooled against vaporizing propane, ammonia, or other refrigerant gas in a second scraped-surface double pipe exchanger. The chilled feed slurry is mixed with more chilled solvent from the solvent recovery system to obtain a filter feed.

The amount of circulating solvent is typically limited by either the capacities of the solvent recovery sections or the capacity of the refrigeration system used to cool the recovered solvent to the desired injection temperatures. These limitations on the solvent availability can restrict the feed rate to the filter since the filter feed (high viscosity oil plus low viscosity solvent) must have a sufficiently low viscosity to achieve an acceptable filtration rate.

At present, dewaxing of waxy feed is performed by mixing the feed with a solvent to completely dissolve the waxy feed at a suitable elevated temperature. The mixture is gradually cooled to an appropriate temperature required for the precipitation of the wax and the wax is separated on a rotary filter drum. The dewaxed oil is obtained by evaporation of the solvent and is useful as a lubricating oil of low pour point.

The dewaxing apparatus is expensive and complicated. In many instances the filtration proceeds slowly and represents a bottleneck in the process because of low filtration rates caused by the high viscosity of the oil/solvent/wax slurry feed to the filter. The high viscosity of the feed to the filter is due to a low supply of available solvent to be injected into the feed stream to the filter. In some cases, lack of sufficient solvent can result in poor wax crystallization and ultimately lower lube oil recovery.

The use of solvents to facilitate wax removal from lubricants is energy intensive due to the requirement for separating from the dewaxed oil and recovery of the expensive solvents for recycle in the dewaxing process.

The solvent is conventionally separated from the dewaxed oil by the addition of heat, followed by a combination of multistage flash and distillation operations. The separated solvent vapors must then be cooled and condensed and further cooled to the dewaxing temperature prior to recycle to the process.

The most limiting factors in the solvent dewaxing process are the cost and size of the filters, the cost, size, and operating expense of the distillation equipment needed to separate the solvent from the dewaxed oil, and the cooling apparatus and cooling capacity required to cool the warm solvent separated from the dewaxed oil.

The filter capacity could be increased if there were available more solvent by simply further diluting the oil/solvent/wax mixture feed to the filter to lower the viscosity of the feed.

However, increasing the amount of solvent available to dilute the feed to the filter requires increasing the means of heating and separating solvent from dewaxed oil and increasing the cooling capacity to cool the separated warm solvent prior to recycle.

The problems to be solved were to increase the amount of solvent available to the solvent dewaxing process without increasing the overall solvent inventory and without increasing the size and capacity of the oil/solvent recovery distillation system and the refrigeration capacity required to cool the warm solvent separated by distillation.

An additional problem to be solved was to increase the filtration capacity of the process without providing additional filtration apparatus.

OBJECT OF THE INVENTION

It is an object of the present invention to increase the amount of dewaxing solvent available to the dewaxing process by increasing the rate of recycle of the solvent to the process.

It is another object of the present invention to increase the amount of dewaxing solvent available to the dewaxing process without increasing the distillation capacity of the oil/solvent recovery system and without increasing the refrigeration capacity required to cool to the dewaxing temperature warm solvent recycled from the oil/solvent recovery system to the dewaxing process.

It is another object of the present invention to utilize a selective permeable membrane to contact cold oil/solvent filtrate from the filter to selectively separate the cold filtrate into a cold solvent permeate stream and a cold filtrate retentate stream which contains the dewaxed oil and the remaining solvent and to recycle the cold solvent permeate stream to the filter feed stream.

It is another object of the present invention to increase the oil/solvent/wax slurry filtration rate by increasing the solvent recycle to the filter feed stream and decreasing the viscosity of the oil/solvent/wax slurry feed to the filter.

It is another object of the present invention to reduce the required distillation capacity of the solvent recovery distillation operations.

SUMMARY OF THE INVENTION

The present invention is directed to a process for solvent dewaxing a waxy oil feed to obtain petroleum oil lubricating stock.

The waxy oil feed is diluted with solvent at the feed temperature, then is sequentially indirectly contacted with cold filtrate and refrigerant which reduce the temperature of the oil to crystallize and precipitate the wax constituents of the oil and is then directly contacted with cold solvent to obtain an oil/solvent/wax mixture. The directly added cold solvent also serves to dilute the oil/solvent/wax mixture in order to maintain a sufficiently low viscosity of the mixture such that the mixture, when fed to a filter, is readily separated into a wax/solvent slurry and a cold dewaxed oil/solvent filtrate stream.

The total amount of solvent added to the waxy oil feed, i.e. the solvent/oil ratio used, and the temperature to which the waxy oil feed is cooled are determined by the boiling range of the feed, the wax content of the feed, and the desired pour point of the dewaxed lubricating oil.

The process includes contacting the dewaxed oil/solvent filtrate stream with a selective permeable membrane to selectively separate the filtrate stream into a solvent permeate stream and a filtrate stream which contains the dewaxed oil and the remaining solvent. The solvent permeate stream is recycled to the filter feed stream. The filtrate stream is then indirectly contacted with the waxy oil feed to cool the waxy oil feed.

In order to increase the rate of solvent transfer through the membrane, the oil/solvent filtrate stream side of the membrane is maintained at a positive pressure relative to the solvent permeate stream side of the membrane.

The recycle of the solvent permeate stream to the filter feed stream substantially increases the amount of solvent available to the dewaxing process and increases the filter feed rate.

The warm waxy oil feed is cooled in a heat exchanger by indirect heat exchange with the cold filtrate to crystallize and precipitate the wax in the oil feed to form an oil/solvent/wax mixture. The oil/solvent/wax mixture is further cooled in a heat exchanger by indirect heat exchange with a cold refrigerant. The cold oil/solvent/wax mixture is further diluted with cold recycled permeate solvent to adjust the viscosity of the mixture and the mixture is fed to a filter which filters and removes the precipitated wax from the cold oil/solvent/wax mixture. A cold wax/solvent slurry is recovered and a cold dewaxed oil/solvent filtrate stream is recovered.

The wax/solvent slurry is treated to recover a wax cake which can be further treated and washed with solvent to remove residual oil from the wax cake. The oil can be separated and recovered from the solvent wash stream and the solvent can be recycled.

The cold oil/solvent filtrate stream is fed, at the filtration temperature, to a selective permeable membrane. The membrane selectively separates the cold filtrate into a cold solvent permeate stream and a cold filtrate stream which contains the dewaxed oil and the remaining solvent. The cold solvent permeate stream at the filtration temperature is recycled to the filter feed stream. The cold filtrate stream is fed to a heat exchanger to indirectly contact and cool the warm waxy oil feed.

The separation and recycle of cold solvent from the oil/solvent filtrate stream to the filter feed achieves a substantial reduction in the amount of solvent that must be separated from the oil/solvent filtrate stream in the oil/solvent separation operation.

The cold oil/solvent filtrate stream, after the selective removal of the solvent through the permeable membrane is sent to an oil/solvent separation operation in which the remaining solvent is removed by distillation from the dewaxed oil, cooled and recycled to the dewaxing process and the dewaxed lubricating oil product is recovered.

A substantial portion of the cold solvent in the filtrate stream is transferred through the selective membrane and recycled directly to the filter feed.

ADVANTAGES

Several benefits are obtained by the solvent dewaxing process of the present invention.

The solvent transferred from the filtrate through the selective permeable membrane and recycled to the filter feed does not have to be either heated in the oil/solvent recovery distillation system to separate the solvent or have to be subsequently cooled prior to recycle to the dewaxing process. More solvent is available to be added to the filter feed since the distillation recovery and/or refrigeration bottlenecks are significantly reduced or eliminated.

The amount of solvent which is made to selectively permeate through the membrane and recycled to the filter feed is limited only by the size and permeability of the membrane and the hydraulic capacity of the rotary filters. As a result of using a selective permeable membrane to separate and directly recycle cold solvent to the filter feed, the internal solvent circulation rate can be substantially increased and can be larger than the flow rate of the solvent recovered from the oil/solvent distillation recovery operation that is recycled to the dewaxing process in a conventional dewaxing process.

The reduction in the viscosity of the oil/solvent/wax feed to the filter, due to the higher availability of solvent achieved by the present invention, leads to an increase in the maximum feed rate to the filters. The higher solvent/oil ratio also contributes to higher oil yields on the filters and greater filter feed rates for heavy stocks which are generally filter area limited.

The selective removal of solvent from the dewaxed oil/solvent filtrate stream by the selective permeable membrane can significantly reduce the distillation capacity required and the cost of removing the remaining solvent in the filtrate stream and reduce the capacity required and cost of subsequently cooling the separated distilled solvent to the dewaxing temperature.

A principal advantage of the use of the selective permeable membrane in accordance with the present invention is that it provides the selective separation of cold solvent from the cold oil/solvent filtrate stream and recycle of the separated solvent at the filtration temperature directly to the filter feed stream.

BRIEF DESCRIPTION OF THE DRAWING

The FIG. 1 is a schematic process flow diagram showing the solvent dewaxing process of the present invention including incremental cooling and incremental solvent addition to a warm waxy oil feed, filtration of wax, a selective permeable membrane for separating solvent from filtrate and recycle of solvent to the filter feed, and recycle of recovered solvent from an oil/solvent recovery operation.

WAXY OIL FEED

Figure 1:
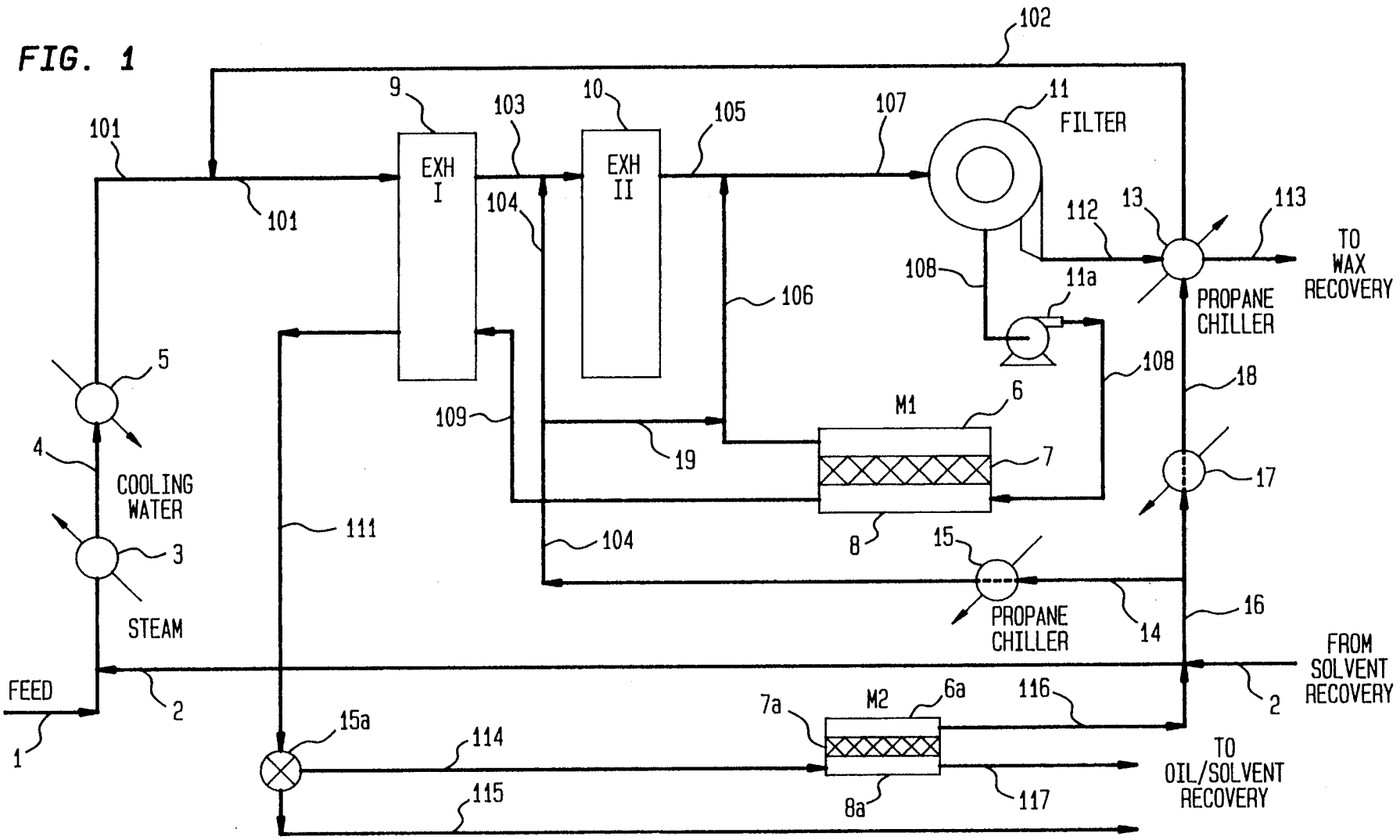

The feed to the process of the present invention can comprise any liquid hydrocarbon containing a dissolved or partially dissolved wax component from which it is desired to remove part or all of the wax component.

The feed to the process of the present invention is typically petroleum lubricating oil raffinates obtained from extraction of distillates and/or deasphalting of vacuum tower distillates.

The waxy oil feed to the process of the present invention is typically a waxy lubricating oil fraction which boils in the range of 580° F. to 1300° F. The fraction boiling from about 580° F. to 850° F. is generally referred to as light lubricating oil distillate. The fraction boiling from about 800° F. to about 1050° F. is generally referred to as heavy lubricating oil distillate. The fraction boiling from about 1050° to about 1300° F. is generally referred to as residual deasphalted oil.

The distillate lubricating oils fed to the process of the present invention, prior to solvent dewaxing, are treated by solvent-extraction processes to remove aromatic and, if needed, asphaltenic compounds. The aromatic solvent extraction step can be carried out using a conventional phenol, furfural or n-methyl-pyrilidone solvent extraction procedure. Deasphalting processes use phenol and/or light hydrocarbon solvents, such as propane or butane. The waxy oil feed to the solvent dewaxing process of the present invention is, accordingly, relatively free of polycyclic aromatic hydrocarbons.

During the dewaxing process, the hydrocarbon feed is diluted with a first portion of solvent and then heated to a temperature to effectively dissolve all of the wax present in the feed. The warm feed is then indirectly cooled with cold water by conventional cooling means such as a tubular heat exchanger. The still warm waxy oil feed is then cooled by indirect heat exchange with cold filtrate and with cold refrigerant and is further cooled and diluted by direct injection of recycle solvent from the recovery operation.

The waxy oil feed is thus sequentially cooled and diluted to its desired wax filtration temperature, which temperature is selected to achieve a desired pour point for the dewaxed oil product.

An oil/solvent/wax mixture is obtained and is further diluted with solvent to adjust the viscosity of the mixture and the mixture is fed to a filter which removes the wax from the oil/solvent/wax mixture. A cold wax cake is recovered and a cold oil/solvent filtrate stream is recovered. The cold oil/solvent filtrate is fed to a selective permeable membrane. The membrane selectively separates the cold filtrate into a solvent permeate stream and a cold filtrate stream which contains the dewaxed oil and the remaining solvent. The cold solvent permeate stream at the filtration temperature is recycled to the filter feed stream. The cold filtrate stream is then contacted with the warm waxy oil feed by indirect heat exchange.

After heat exchange with the warm waxy oil feed, the filtrate is sent to an oil/solvent separation operation in which the remaining solvent is removed from the dewaxed oil and recycled to the dewaxing process and the wax free lubricating oil stock product is recovered.

Typical distillate feeds to the process of this invention are:

Approximate Boiling Range Light Neutral Lubricating Oil Feed Stock 580°–850° F. Heavy Neutral Lubricating Oil Feed Stock 850°–1050° F. Deasphalted Lubricating Oil Feed Stock 1050°–1300° F.

The term cloud point as used herein is intended to mean the temperature at which wax crystallization begins to occur, and the term pour point is the minimum temperature at which the oil will first move in a standard tube after quickly turning the tube on its side following a standard chilling procedure as set forth in ASTM test method D-97.

Dewaxing Solvent

The dewaxing solvents used in the present invention can be an aliphatic ketone, such as acetone, methyl ethyl-ketone (MEK), diethyl ketone, methyl n-propyl ketone, methyl isopropyl ketone, methyl-n-butyl ketone, methyl isobutyl ketone or other lower aliphatic ketones and mixtures thereof. The solvent also can include an aromatic solvent such as benzene, toluene, xylene and the like. The preferred solvent is a mixture of methyl ethyl ketone and toluene.

The dewaxing solvent used in the present invention performs several important functions. The solvent dilutes the waxy oil feed and dissolves the oil component, cools the oil feed to the dewaxing temperature and lowers the solubility of the wax in the oil, forms a wax precipitate having a crystalline structure that facilitates separation of the wax from the oil and solvent in a filtration step and maintains a desired low viscosity to facilitate handling and processing of the oil/solvent/wax mixture through the heat exchangers and filters used in the process.

The process of the present invention, in a preferred embodiment, employs a mixture of MEK and toluene solvents. The MEK has poor solvent power for wax and relatively good solvency for oil. The toluene is included to increase oil solubility at dewaxing temperatures and to reduce oil/solvent solution viscosity to improve its filterability.

The use of solvents with high ketone content is beneficial because it increases filter rates by virtue of its lower viscosity and it reduces the dewaxing temperature differential between filtration temperature and pour point of dewaxed oil due to its lower wax solution power relative to toluene.

The volume percent ratio of MEK/toluene can be 25:75 to 100:0, preferably 40:60 to 80:20 and typically about 65:35. The preferred ratios depend on the waxy oil raffinate feed to be dewaxed.

For dewaxing of light neutral lube oil feed stock the ratio of MEK/toluene can be 65:35 to 95:5; for dewaxing heavy neutral lube oil feed stock the ratio of MEK/toluene can be 50:50 to 75:25, and for dewaxing deasphalted lube oil feed stock the ratio of MEK/toluene can be 40:60 to 70:30.

The solvent is added to the waxy oil feed sequentially at a number of injection points in the chilling train. The manner of solvent addition affects crystal size and subsequent filtration rates. Large, well defined crystals result in high filter rates and good washing efficiency with a corresponding high dewaxed oil yield and a low oil content wax product. Small or ill-defined crystals form a cake with resultant poor filtration characteristics which lead to lower dewaxed oil yields, poor wax quality and reduced oil production rates.

All solvent additions made at or below wax crystallization temperature should be made at about the same temperature as the oil/solvent/wax to which it is added to avoid shock chilling which promotes formation of fine, difficult to filter crystals.

The table below shows a typical dilution schedule for a light and a heavy neutral distillate stock.

TABLE 1

| Addition Point[1] | Amount of Diluent Added[2] Solvent Oil Ratio Vol. % | |
|---|---|---|
| | Light Neutral Lubricating Oil Feed Stock[3] | Heavy Neutral Lubricating Oil Feed Stock[4] |
| Primary (Line 2) | 50 | 70 |
| Recycle (Line 102) | 100 | 150 |
| Recycle (Line 104) | 30 | 0 |
| Recycle (Line 106) | 100 | 100 |

[1]See FIG. 1 of drawing.
[2]Solvent addition is based on a 10,000 BD lube dewaxing plant.
[3]Ratio MEK/tol. 75/25
[4]Ratio MEK/tol. 60/40

The solvent is added step-wise during the process in order to maintain the viscosity of the oil/solvent/wax mixture at a desirable low level to facilitate handling and processing of the mixture through the scraped surface double pipe heat exchangers and the filtration of the wax in the filter apparatus.

The total solvent dilution to oil feed ratio will depend to a large extent on the wax content of the feed, the viscosity of the feed and the desired pour point of the dewaxed oil product. The term total solvent to oil dilution ratio as used herein is intended to mean the total volume of the solvent that is added to the initial volume of the oil feed during the dewaxing process.

The total solvent to oil ratio can, accordingly, be 6:1 to 1:1, typically 4:1 to 3:1, depending on the nature and viscosity of the waxy oil feed.

The dewaxing temperature is the temperature at which the oil/solvent/wax mixture is fed to the rotary filter drum and depends primarily on the desired pour point of the dewaxed oil product. Typical dewaxing temperatures for light neutral lubricating stocks are −23° C. to −18° C., and for heavy neutral stocks are −18° C. to −7° C.

Dewaxing Aids

The filterability of oil/solvent/wax mixtures is dependent to a great extent on the size and shape of the wax crystals. Crystal growth can be affected by use of low chilling rates and high solvent concentrations. Dewaxing aids or wax crystal modifiers have been found effective in dewaxing of certain heavy lube oil stocks. These can be either nucleating agents that initiate crystal growth or growth modifiers that affect crystal growth. The crystals that are obtained are compact and are more readily separated from the oil. The conventional dewaxing aids can be used in the present process.

APPARATUS

Membrane

In the present invention, a membrane module comprised of either hollow fibers or spiral wound or flat sheets is used to selectively remove cold solvent from the filtrate for recycle to the filter feed. The selective separation of the solvent and the recycle of the permeate solvent to the filter feed are both carried out at the filter temperature or at about the filter temperature. The optimum level of solvent removal is a function of filter feed properties and unit specific operating constraints. The present invention allows a significant increase in waxy oil feed rate to a dewaxing plant by debottlenecking the filtration, refrigeration and oil recovery sections of the plant.

A preferred membrane module is described as follows:

For the solvent-oil separation of the present invention, the membrane materials that can be used include, but are not limited to isotropic or anisotropic materials constructed from polyethylene, polypropylene, cellulose acetate, polystyrene, silicone rubber, polytetrafluoroethylene, polyimides, or polysilanes. Asymmetric membranes may be prepared by casting a polymer film solution onto a porous polymer backing, followed by solvent evaporation to provide a permselective skin and coagulation/washing. A suitable polyimide, based on 5(6)-amino-1-(4'-aminophenyl)-1,3-trimethylindane, is commercially available as "Matrimid 5218". The membrane can be configured as either a flat sheet (plate and frame), hollow fiber, or spiral wound module. For the present invention, a spiral wound module is preferred due to its balance between high surface area and resistance to fouling. Typical construction of such a module comprises layers of the selected membrane wound upon a perforated metal or solvent resistant tube. The membrane layers would be separated by alternate layers of permeate and retentate spacers sized to provide an acceptable pressure drop from inlet to outlet of typically 2–10 psig. Appropriate adhesives and sealants designed to maintain separate permeate and retentate flow channels and to minimize structural rearrangement upon use complete the construction. Modules of any size can be constructed, but typically are 10 inches in diameter and 48 inches long having 200–300 $ft^2$ surface area. Feed flow to each module varies according to application but is on the order of 8,000–10,000 gal/day; the corresponding permeate rate is on the order of 1,000–2,000 gal/day. Typical trans-membrane pressure drop is about 400–600 psi. A commercial installation will vary in size with application and specific membrane performance but will typically employ on the order of 500–1500 modules for a world scale lube dewaxing plant.

It is recognized that a multiplicity of membrane modules can be used either in series or in parallel or any combination of multi-stage parallel units within this arrangement.

Selective permeable membranes useful for the present process are disclosed in Pasternak U.S. Pat. No. 4,985,138, Winston, et al. U.S. Pat. No. 4,990,275, Thompson, et al. U.S. Pat. No. 4,368,112 and I-F Wang et al. U.S. Pat. No. 5,067,970. A preferred membrane is disclosed in W. R. Grace & Co. patent application (Disclosure #018259), filed concurrently herewith by L. S. White et al., entitled "Polyimide Membrane and Process for Separation of Solvents from Lube Oil" granted as U.S. Pat. No. 5,264,166. The above disclosures are incorporated herein by reference.

Scraped-Surface Double Pipe Heat Exchangers

The chilled oil/solvent flows through the scraped-surface double pipe heat exchangers and is cooled by indirect heat exchange with cold filtrate. The wax crystallization begins in the first of two or more such heat exchangers. The cold surface of the heat exchanger is continually scraped to remove crystallized wax and to maintain the wax dispersed in the oil/solvent liquid.

A second type of scraped-surface double pipe heat exchanger that can be used is one in which a vaporizing propane refrigerant is used to cool the waxy oil feed. The oil/solvent liquid is further cooled and additional wax crystallized in the later used heat exchangers. As before, the surfaces of the heat exchanger are continually scraped to remove crystallized wax and to maintain the wax dispersed in the oil/solvent liquid.

Filter

The wax can be separated from the cold oil/solvent-/wax mixture by filtration or centrifugation.

The cold oil/solvent/wax mixture flows from the double pipe heat exchangers to an injected dilution solvent step and then to a rotary drum vacuum filter in which a compartmentalized cloth covered drum rotates, partly submerged in enclosed filter cases in which the wax is separated from the oil/solvent liquid.

A wax-free oil/solvent filtrate solution is drawn through the filter cloth to filtrate tanks in which a vacuum which induces filtration is maintained. A wax cake is deposited upon the drum filter cloth during filtration and is washed on the filter cloth continuously and automatically with cold solvent to produce a low oil content wax product.

The wax cake is then removed from the filter cloth and recovered for further processing.

The principal features of the dewaxing process of the present invention are the large amount of solvent that is transferred through the selective permeable membrane for recycle directly to the filter feed, the temperature of the cold oil/solvent filtrate from which the solvent is selectively removed and the total volume of dilution solvent to oil, i.e. total solvent/oil ratio available to carry out the dewaxing process.

The amount of solvent that is transferred from the oil/solvent filtrate through the selective permeable membrane for recycle to the filter feed represents solvent that does not have to be recovered from the oil/-solvent filtrate by distillation and does not have to be subsequently cooled prior to recycle to the dewaxing process, thus resulting in substantial savings in solvent inventory, distillation capacity and refrigeration capacity.

The direct recycle and introduction of the cold solvent from the oil/solvent filtrate into the filter feed provides more efficient use of the available solvent inventory and refrigeration capacity.

The solvent performs the functions of diluent, solvent for the oil, coolant and non-solvent for the wax. The solvent is added to the waxy oil feed at different points along the dewaxing process sequence. The total amount of solvent added is referred to herein as the total solvent/oil ratio and is based on the total volume of solvent added to the waxy oil feed during the dewaxing process.

The total solvent to oil dilution ratio can be 6:1 to 1:1 and depends primarily on the type of waxy oil feed and the desired dewaxed oil pour point.

The dewaxing temperature is dependent upon the desired pour point of the dewaxed oil and is typically a few degrees below the pour point, for example, 5° to 10° F. below the pour point. The pour point is also dependent on the type of oil feed.

DETAILED DESCRIPTION OF THE INVENTION

A detailed description of the process of the present invention is given with reference to the FIG. 1 of the drawing. A waxy oil feed, after removal of aromatic compounds by convention phenol or furfural extraction, is fed through line 1 at a temperature of about 130° to 200° F. and is mixed with MEK/toluene solvent fed through line 2 at a temperature of 100° to 140° F. from the solvent recovery section, not shown. The solvent is added at a volume ratio of 0.5 to 3.0 solvent per part of waxy oil feed. The waxy/oil solvent mixture is fed to heat exchanger 3 and heated by indirect heat exchange to a temperature above the cloud point of the mixture of about 140° to 210° F. to insure that all wax crystals are dissolved and in true solution. The warm oil/solvent mixture is then fed through line 4 to heat exchanger 5 in which it is cooled to a temperature of about 100° to 180° F.

The waxy oil feed in line 101 is then mixed directly with solvent at a temperature of 40° to 140° F. fed through line 102 to cool the feed to a temperature of 40° to 140° F., depending on the viscosity, grade and wax content of the waxy oil feed. The solvent is added to the waxy oil feed through line 102 in an amount of 0.5 to 2.0 parts by volume per part of waxy oil in the feed. The temperature and solvent content of the cooled waxy oil feed stream in line 101 is controlled at a few degrees above the cloud point of the oil feed/solvent mixture to preclude premature wax precipitation.

A typical target temperature for the feed in line 101 would be 40°–140° F.

The cooled waxy oil feed and solvent are fed through line 101 to scraped-surface double pipe heat exchanger 9.

The cooled waxy oil feed is further cooled by indirect heat exchange in heat exchanger 9 against cold filtrate fed to the heat exchanger 9 through line 109. It is in heat exchanger 9 that wax precipitation typically first occurs. The cooled waxy oil feed is withdrawn from exchanger 9 by line 103 and is injected directly with additional cold solvent feed through line 104. The cold solvent is injected through line 104 into line 103 in an amount of 0 to 1.5, e.g. 0.1 to 1.5, parts by volume based on one part of waxy oil feed. The waxy oil feed is then fed through line 103 to direct heat exchanger 10 and is further cooled against vaporizing propane in scraped-surface, double pipe heat exchanger 10 in which additional wax is crystallized from solution. The cooled waxy oil feed is then fed through line 105 and mixed with additional cold solvent injected directly through line 106. The cold solvent is fed through line 106 in an amount of 0.1 to 3.0, e.g. 0.5 to 1.5, parts by volume per part of waxy oil feed. The final injection of cold solvent at or near the filter feed temperature through line 106 serves to adjust the solids content of the oil/solvent-/wax mixture feed to the filter 11 to 3 to 10 volume percent, in order to facilitate filtration and removal of the wax from the waxy oil/solvent/wax mixture feed to the filter 11. The mixture is then fed through line 107 to the filter 11 and the wax is removed. The temperature at which the oil/solvent/wax mixture is fed to the filter is the dewaxing temperature and can be −10° to +20° F. (−23° to −7° C.) and determines the pour point of the dewaxed oil product.

If desired, a slipstream 19 from line 104 can be combined with the solvent in line 106 to adjust the solvent temperature prior to injecting the solvent in line 106 into line 107. The remaining solvent in line 104 is injected into line 103 to adjust the solvent dilution and viscosity of the oil/solvent/wax mixture feed prior to feeding the mixture through line 103 to the exchanger 10. The oil/solvent/wax mixture in line 107 is then fed to rotary vacuum drum filter 11 in which the wax is separated from the oil and solvent.

One or more filters 11 can be used and they can be arranged in parallel or in a parallel/series combination. A separated wax is removed from the filter through line 112 and is fed to indirect heat exchanger 13 to cool solvent recycled from the solvent recovery operation. The cold filtrate is removed from filter 11 through line 108 and at this point contains a solvent to oil ratio of 15:1 to 2:1 parts by volume and is at a typical temperature of −10° to +50° F.

The cold filtrate in line 108 is increased in pressure by pump 11A and fed through line 108 to selective permeable membrane module M1 at the filtration temperature. The membrane module M1 contains a low pressure solvent permeate side 6 and a high pressure oil/solvent filtrate side 8 with the selective permeable membrane 7 in between. The cold oil/solvent filtrate at the filtration temperature is fed through line 108 to the membrane module M1. The membrane 7 allows the cold MEK/tol solvent from the oil/solvent filtrate side 8 to selectively permeate through the membrane 7 into the low pressure permeate side 6 of the membrane module. The cold solvent permeate is recycled directly to the filter feed line 107 at the filter feed temperature.

The solvent selectively permeates through the membrane 7 in an amount of 0.1 to 3.0 parts by volume per part of waxy oil in the feed.

About 10 to 100%, typically 20 to 75% and more typically 25 to 50% by volume of the MEK/tol. solvent in the cold filtrate permeates through the membrane and is recycled to the filter feed line 107. The removal of cold solvent from the filtrate and the recycle of the removed solvent to the filter feed reduces the amount of solvent needed to be recovered from the oil/solvent filtrate and reduces the amount of heat required to subsequently heat and distill the solvent from the filtrate in the solvent recovery operation, respectively. Higher oil filtration rates and lower oil-in-wax contents are obtained as a result.

The filtrate side of the membrane is maintained at a positive pressure of about 200–1000 psig and preferably 400–800 psig greater than the pressure of the solvent permeate side of the membrane to facilitate the transport of solvent from the oil/solvent filtrate side of the membrane to the solvent permeate side of the membrane. The solvent permeate side of the membrane is typically at 0–600 psig, preferably 10–100 and more preferably 10–50, for example at about 25 psig.

The membrane 7 has a large surface area which allows very efficient selective solvent transfer through the membrane.

The cold filtrate removed from the membrane module M1 is fed through line 109 to indirect heat exchanger 9, in which it is used to indirectly cool warm waxy oil feed fed through line 101 to the heat exchanger 9. The amount of solvent to be removed by the membrane module M1 is determined, to some extent, by the feed pre-cooling requirements. The cold filtrate is then fed through line 111 to line 115 and sent to an oil/solvent separation operation in which the remaining solvent is removed from the dewaxed oil.

The solvent is separated from the oil/solvent filtrate in the oil/solvent recovery operation, not shown, by heating and removing the solvent by distillation. The separated solvent is recovered and returned through line 2 to the dewaxing process. The wax and solvent free oil product is recovered and used as lubricating oil stock.

A portion of the solvent from the solvent recovery operation is fed through line 2 at a temperature of about 100° to 140° F. to be mixed with waxy oil feed fed through line 1. Another portion of the recovered solvent is fed through line 2 to line 16 and into heat exchangers 17 and 13 in which the solvent is cooled to about the dewaxing temperature by indirect heat exchange against cooling water and wax/solvent mixture, respectively. Another portion of the recovered solvent is fed through lines 2, 16 and 14 to heat exchanger 15 in which it is cooled by indirect heat exchange with cold refrigerant, e.g. vaporizing propane, to about the fluid temperature in line 103 and fed through line 104 and injected into the oil/solvent/wax mixture in line 103.

In an alternative embodiment of the present invention the filtrate stream in line 111 can be fed through valve **15*a* and line 114 to membrane module M2. The filtrate is fed to module M2 at a temperature of 59° to 122° F. (15° to 50° C.) and solvent is selectively transferred through the membrane 7*a* and is fed through line 116 and recycled to the dewaxing process. The membrane module M2 is operated in the same manner as membrane module M1, except for the temperature of separation, and can contain the same membrane as module M1**.

The use of the membrane module M2 embodiment allows reducing cooling capacity requirements and reducing utility consumption in the solvent/oil recovery section. However, since the recovered solvent permeate is at a higher temperature, i.e., 59° to 122° F., than the solvent recovered from module M1 the solvent from the membrane module M2 must be cooled prior to being used in the dewaxing process, as for example in heat exchangers 15 or 17 and 13. The higher temperature, however, allows more solvent to be recovered because of the higher permeate rate of the higher temperature as compared to M1.

DESCRIPTION OF PREFERRED EMBODIMENTS

Light Neutral Lubricating Oil Feed Stock

A light lubricating oil feed boiling in the range of 550° to 1000° F., preferably 570° to 900° F. and more preferably 580° to 850° F., is treated to remove aromatic compounds and is pre-diluted with solvent, heated to melt wax crystals and cooled. A MEK/tol. solvent is used at a ratio of MEK/tol. of 25:75 to 100:0, preferably 60:40 to 90:10, and more preferably 70:30 to 80:20.

The total solvent to oil dilution ratio is 6:1 to 1:1, preferably 5:1 to 2:1, and more preferably 4:1 to 2:1.

The dewaxing temperature, i.e., the temperature at which the oil/solvent/wax mixture is fed to to the filter, is −20° to +70° F., preferably −10° to +30° F., and more preferably −10° to +10° F.

The oil/solvent filtrate from the filter contains a ratio of solvent to oil of 6:1 to 1:1, preferably 5:1 to 3:1.

The oil/solvent filtrate is fed to the membrane module M1 at the dewaxing temperature.

The operating temperature of the selective membrane can be −20° to +70° F., preferably −10° to +30° F., and more preferably −10° to +10° F.

The oil/solvent filtrate side of the membrane is maintained at a positive pressure relative to the solvent permeate side of the membrane of 200 to 1000 psig, preferably 400 to 800 psig, and more preferably 500 to 700 psig. The solvent permeate side of the membrane is typically maintained at a pressure of 10 to 50 psig.

There is transferred through the membrane module M1 10 to 100 vol. % of the solvent in the oil/solvent filtrate stream, preferably 20 to 75 vol. %, and more preferably 25 to 50 vol. %.

A sufficient amount of solvent is transferred through the membrane to add 0.1 to 2.0 parts and preferably 0.5 to 1.5 parts of solvent per part of oil feed to the filter feed.

A dewaxed oil is obtained having a pour point of −20° to +70° F. preferably −10° to 30° F., and more preferably −5° to +10° F.

Heavy Neutral Lubricating Oil Feed Stock

A heavy neutral lubricating oil feed boiling in the range of −700° F. to 1300° F., preferably 800° to 1150° F., and more preferably 850° to 1050° F. is treated to remove aromatic compounds and is pre-diluted with solvent, heated to melt wax crystals and cooled. A MEK/tol. solvent is used at a ratio of MEK/tol. of 25:75 to 100:0, preferably 50:50 to 70:30 and more preferably 55:45 to 65:35.

The total solvent to oil dilution ratio is 6:1 to 1:1, preferably 4:1 to 2:1, and more preferably 4:1 to 3:1.

The dewaxing temperature, i.e., the temperature at which the oil/solvent/wax mixture is fed to to the filter, is −20° to +70° F., preferably 0° to 50° F., and more preferably 10° to 20° F.

The oil/solvent filtrate from the filter contains a ratio of solvent to oil of 6:1 to 1:1, preferably 5:1 to 2:1 and more preferably 5:1 to 3:1.

The oil/solvent filtrate is fed to the membrane module M1 at the dewaxing temperature.

The operating temperature of the selective membrane can be −20° to +70° F., preferably 0° to 50° F., and more preferably 10° to 20° F.

The oil/solvent filtrate side of the membrane is maintained at a positive pressure relative to the solvent permeate side of the membrane of 200 to 1000 psig, preferably 400 to 800 psig, and more preferably 500 to 700 psig.

There is transferred through the membrane module M1 10 to 100 vol. % of the solvent in the oil/solvent filtrate stream, preferably 20 to 75 vol. % and more preferably 25 to 50 vol. %.

A sufficient amount of solvent is transferred through the membrane to add 0.1 to 3.0 parts, preferably 0.5 to 1.5 parts of solvent per part of oil feed to the filter feed.

A dewaxed oil is obtained having a pour point of −10° to +70° F., preferably 10° to 60° F., and more preferably 15° to 30° F.

Deasphalted Lubricating Oil Feed Stock

A deasphalted lubricating oil feed boiling in the range of 600° to 2500° F., preferably 900° to 1500° F., and more preferably 1050° to 1300° F. is treated to remove aromatic compounds and is pre-diluted with solvent, heated to melt wax crystals and cooled. A MEK/tol. solvent is used at a ratio of MEK/tol. of 25:75 to 100:0, preferably 45:55 to 70:30 and more preferably 50:50 to 60:40.

The total solvent to oil dilution ratio is 6:1 to 1:1, preferably 5:1 to 2:1, and more preferably 5:1 to 3:1.

The dewaxing temperature, i.e., the temperature at which the oil/solvent/wax mixture is fed to to the filter, is −20° to +70° F., preferably 0° to 50° F., and more preferably 10° to 30° F.

The oil/solvent filtrate from the filter contains a ratio of solvent to oil of 6:1 to 1:1, preferably 5:1 to 2:1 and more preferably 5:1 to 3:1.

The oil/solvent filtrate is fed to the membrane module M1 at the dewaxing temperature.

The operating temperature of the selective membrane can be −20° to +70° F, preferably 0° to 50° F., and more preferably 10° to 30° F.

The oil/solvent filtrate side of the membrane is maintained at a positive pressure relative to the permeate solvent side of the membrane of 200 to 1000 psig, preferably 400 to 800 psig, and more preferably 500 to 700 psig.

There is transferred through the membrane module M1 10 to 100 vol. % of the solvent in the oil/solvent filtrate stream, preferably 20 to 75 vol. % and more preferably 25 to 50 vol. %.

A sufficient amount of solvent is transferred through the membrane to add 0.1 to 3.0 parts, preferably 0.5 to 1.5 parts of solvent per part of oil feed to the filter feed.

A dewaxed oil is obtained having a pour point of −10° to +70° F. preferably 10° to 60° F., and more preferably 20° to 30° F.

Though the process and economic advantages of the present invention have been described as they apply to solvent lube dewaxing using MEK/toluene solvent, the invention can also be utilized in a similar manner in other solvent dewaxing systems, such as in propane dewaxing.

The dewaxed oil can be used as lubricating oil stock.

The present invention is illustrated by the following Examples.

EXAMPLE 1

A light neutral lubricating oil feed boiling in the range of 650° to 840° F. is treated to remove undesirable aromatic compounds and is prediluted with solvent, is heated to melt wax crystals and is cooled. The waxy oil feed is then fed to the dewaxing process at a rate of 14,000 barrels a day based on oil feed.

The solvent consists of a ratio of MEK/tol. of 70:30. The total solvent to oil dilution ratio is 4:1 based on volume.

The dewaxing temperature, i.e., the oil/solvent/wax mixture feed to the filter temperature is −5° F.

The filter removes the wax from the oil/solvent/wax mixture. A cold wax cake is recovered and a cold oil/-solvent filtrate stream is recovered. The cold oil/solvent filtrate stream is fed to the membrane module M1.

The membrane is incorporated in a spiral wound module having high surface area and low propensity for fouling. The module comprises layers of the membrane wound upon a perforated metal resistant tube. The membrane layers are separated by alternate layers of permeate and retenate spacers sized to provide an acceptable pressure drop from inlet to outlet of about 2 to 10 psig. Adhesives and sealants are used to maintain separate permeate and retenate flow channels. The modules are constructed to be 10 inches in diameter and 48 inches in length and to have a 200 to 300 $ft^2$ surface area. 500 modules are used. The solvent permeate feed rate for each module is 1,100 gal/day.

The oil/solvent filtrate stream is fed to the membrane module at a rate of 50,400 barrels a day of solvent and 10,500 barrels a day of dewaxed oil.

The oil/solvent filtrate stream side of the membrane is maintained at a positive pressure of 800 psig and the solvent permeate side of the membrane is maintained at about 200 psig. About 12,000 barrels a day of cold solvent is selectively transferred through the membrane and is recycled at a temperature of −5° F. directly to the filter feed stream.

There is recovered about 10,500 barrels a day of dewaxed oil having a pour point of +5 and, after further conventional treatment, 3500 barrels a day of slack wax having an oil content of 10 to 25 vol. % oil.

The process of the present invention results in substantial savings in distillation capacity to recover solvent from filtrate and in refrigeration capacity to cool the warmed separated solvent from the solvent/oil recovery operation to the necessary dewaxing temperature. In addition, there are considerable savings in solvent inventory requirements.

In order to illustrate the savings achieved by the practice of the present invention, a comparison is made between the process of the present invention, in which a selective membrane is used, and the prior art process without the selective membrane.

The process of the present invention, as compared to the prior art process to obtain the same level of dewaxing and pour point oil, achieves an about 40% reduction in the size and capacity of the oil/solvent recovery section and an about 50% reduction in the heat energy required to carry out solvent recovery as well as an about 45% reduction in the total refrigeration requirements.

The total refrigeration requirements include the refrigeration required to cool the feed and crystallize wax from the feed, e.g., the refrigeration needed for the scraped-surface heat exchangers, as well as the refrigeration required to cool the warm distilled solvent from the solvent recovery operation to the dewaxing temperature.

EXAMPLE 2

A heavy neutral lubricating oil feed boiling in the range of 850° to 1050° F. is treated to remove undesirable aromatic compounds and is prediluted with solvent, is heated to melt wax crystals and is cooled. The waxy oil feed is then fed to the dewaxing process at a rate of 11,000 barrels a day based on oil feed.

The solvent consists of a ratio of MEK/tol. of 65:35. The total solvent to oil dilution ratio is 4:1 based on volume.

The dewaxing temperature, i.e. the feed to the filter temperature, is +10° F.

The filter removes the wax from the oil/solvent/wax mixture. A cold wax cake is recovered and a cold oil/solvent filtrate stream is recovered. The cold oil/solvent filtrate stream is fed to the membrane module M1.

The membrane and module are the same as that of Example 1.

The oil/solvent filtrate stream is fed to the membrane module at a rate of 46,200 barrels a day of solvent and 8,800 barrels a day of dewaxed oil.

The oil/solvent filtrate stream side of the membrane is maintained at a positive pressure of 700 psig and the solvent permeate side of the membrane is maintained at about 100 psig. About 15,000 barrels a day of cold solvent is selectively transferred through the membrane and is recycled at a temperature of +10° F. directly to the filter feed stream.

There is recovered about 8,800 barrels a day of dewaxed oil having a pour point of 20° F. and, after further conventional treatment, 2,200 barrels a day of slack wax having an oil content of 15 to 35 vol. % oil.

The process of the present invention results in substantial savings in distillation capacity to recover solvent from filtrate and refrigeration capacity to cool the warmed separated solvent from the solvent/oil recovery operation to the necessary dewaxing temperature. In addition, there are considerable savings in solvent inventory requirements.

In order to illustrate the savings achieved by the practice of the present invention, a comparison is made between the process of the present invention, in which a selective membrane is used, and prior art process without the selective membrane.

The process of the present invention, as compared to the prior art process to obtain the same level of dewaxing and pour point oil, achieves an about 40% reduction in the size and capacity of the oil/solvent recovery section and an about 45% reduction in the heat energy required to carry out solvent recovery as well as an about 40% reduction in the total refrigeration requirements.

EXAMPLE 3

A deasphalted lubricating oil feed boiling in the range of 1050° to 1240° F. is treated to remove undesirable aromatic compounds and is prediluted with solvent, is heated to melt wax crystals and is cooled. The waxy oil feed is then fed to the membrane module at a rate of 10,000 barrels a day based on oil feed.

The solvent consists of a ratio of MEK/tol. of 50:50. The total solvent to oil dilution ratio is 5.5:1 based on volume.

The dewaxing temperature, i.e. the feed to the filter temperature, is 15° F.

The filter removes the wax from the oil/solvent/wax mixture. A cold wax cake is recovered and a cold oil/solvent filtrate stream is recovered. The cold oil/solvent filtrate stream is fed to the membrane module M1.

The membrane and module are the same as that of Example 1.

The oil/solvent filtrate stream is fed to the membrane module at a rate of 51,600 barrels a day of solvent and 7,800 barrels a day of dewaxed oil.

The oil/solvent filtrate stream side of the membrane is maintained at a positive pressure of 800 psig and the solvent permeate side of the membrane is maintained at about 200 psig. About 13,000 barrels a day of cold solvent is selectively transferred through the membrane and is recycled at a temperature of 15° F. directly to the filter feed stream.

There is recovered about 7,800 barrels a day of dewaxed oil having a pour point of 25° F. and, after further conventional treatment, about 2100 barrels a day of slack wax having an oil content of 10 to 15 vol. % oil.

The process of the present invention results in substantial savings in distillation capacity to recover solvent from filtrate and in refrigeration capacity to cool the warmed separated solvent from the solvent/oil recovery operation to the necessary dewaxing temperature. In addition, there are considerable savings in solvent inventory requirements.

In order to illustrate the savings achieved by the practice of the present invention, a comparison is made between the process of the present invention, in which a selective membrane is used, and the prior art process without the selective membrane.

The process of the present invention, as compared to the prior art process to obtain the same level of dewaxing and pour point oil, achieves an about 35% reduction in the size and capacity of the oil/solvent recovery section and an about 30% reduction in the heat energy required to carry out solvent recovery as well as an about 30% reduction in the total refrigeration requirements.

Although the invention has been illustrated by reference to specific embodiments and examples, it will be apparent to those skilled in the art that various changes and modifications may be made which fall within the scope of the invention. The scope of the invention is to be interpreted and construed in accordance with the attached claims.

What is claimed is:

1. A process for solvent dewaxing a waxy oil feed comprising dilution of the waxy oil feed stream with solvent and cooling the waxy oil feed stream to a temperature of 40° to 140° F., and further cooling the waxy oil feed by indirect contact with the cold filtrate, then sequentially indirectly cooling the waxy oil feed in indirect heat exchangers to crystallize and precipitate wax crystals, sequentially directly injecting additional solvent into the waxy oil feed stream to further cool and dilute and to obtain a desired viscosity of the waxy oil feed stream to facilitate handling of the waxy oil feed stream through the process and to facilitate filtering crystallized wax from the waxy oil feed and to obtain the desired pour point of dewaxed oil product, and during the sequential cooling of the waxy oil feed crystallizing and precipitating wax from the waxy oil feed to obtain an oil/solvent/wax mixture at a temperature of −30° to +70° F., feeding the oil/solvent/wax mixture to a filter to remove the wax and obtain an oil/solvent filtrate stream, contacting the oil/solvent filtrate stream at a temperature of −30° to +70° F. with one side of a selective semipermeable membrane in a membrane module to selectively transfer solvent through the membrane to obtain a solvent permeate on the other side of the membrane, the oil/solvent filtrate stream side of the membrane is maintained at a positive pressure relative to a pressure on the solvent permeate side of the membrane, selectively transferring 20 to 75% by volume of the solvent from the filtrate side of the membrane to the solvent permeate side of the membrane, and recycling the solvent permeate at a temperature of −30° to +70° F. to the filter feed, withdrawing a filtrate stream containing the remaining solvent from the filtrate side of the membrane module, contacting the filtrate stream by indirect heat exchange with the warm waxy oil feed, and treating the withdrawn filtrate stream to separate the remaining solvent from the oil, and recovering a dewaxed oil product stream, and a slack wax product stream and recycling the separated solvent to the dewaxing process.

2. The process of claim 1 wherein the solvent to oil ratio in the oil/solvent filtrate stream is 15:1 to 3:1 based on volume.

3. The process of claim 1 wherein the dewaxing solvent contains methyl ethyl ketone in a ratio to toluene of 25:75 to 100:0 by volume.

4. The process of claim 1 wherein the membrane transfer temperature is −30° to +70° F.

5. The process of claim 1 wherein the total solvent to oil dilution ratio is 6:1 to 1:1.

6. The process of claim 1 wherein the pour point of the dewaxed oil obtained is −20° to 70° F.

7. The process of claim 1 wherein the oil content of the slack wax obtained is 5 to 35 vol %.

8. The process of claim 1 wherein the waxy oil feed is a light neutral lubricating oil stock having a boiling range of 580° to 850° F.

9. The process of claim 1 wherein the waxy oil feed is a heavy neutral lubricating oil stock having a boiling range of 850° to 1050° F.

10. The process of claim 1 wherein the waxy oil feed is a deasphalted lubricating oil stock having a boiling range of 1050° to 1300° F.

* * * * *